US012270412B2

(12) United States Patent
Lyons et al.

(10) Patent No.: US 12,270,412 B2
(45) Date of Patent: Apr. 8, 2025

(54) BLOWER HAVING A PROTRUSION ADJACENT THE STATIC TAP HOLE

(71) Applicant: Regal Beloit America, Inc., Beloit, WI (US)

(72) Inventors: Leslie A. Lyons, Cassville, MO (US); David A. Fisher, Cassville, MO (US)

(73) Assignee: Regal Beloit America, Inc., Beloit, WI (US)

( * ) Notice: Subject to any disclaimer, the term of this patent is extended or adjusted under 35 U.S.C. 154(b) by 253 days.

(21) Appl. No.: 17/495,545

(22) Filed: Oct. 6, 2021

(65) Prior Publication Data

US 2023/0107170 A1 Apr. 6, 2023

(51) Int. Cl.

*F04D 29/42* (2006.01)
*F04D 17/10* (2006.01)
*F04D 27/00* (2006.01)

(52) U.S. Cl.

CPC ..... *F04D 29/4226* (2013.01); *F04D 17/10* (2013.01); *F04D 27/001* (2013.01)

(58) Field of Classification Search

CPC ..... F04D 27/001; F04D 17/10; F04D 29/281; F04D 25/08; F04D 29/30; F04D 29/282; F04D 29/4226; F04D 15/0077; F04D 15/0083; F04D 27/008; F04D 27/0292; F05D 2270/301; F05D 2250/52; G01F 1/34; G01L 19/00–16; G01L 19/0007; G01L 19/0038; G01L 19/06; G01L 19/0609; G01L 19/14; G01L 7/00–24; G01L 9/00–18; G01L 11/00–06

USPC ..... 415/206, 118, 223; 29/889.4; 110/162

See application file for complete search history.

(56) References Cited

U.S. PATENT DOCUMENTS 5,839,374 A * 11/1998 Conner ..... F04D 27/008 110/162
6,126,392 A * 10/2000 Sabini ..... F04D 15/0088 415/118
6,575,696 B1 6/2003 Lyons et al.
7,614,250 B2 11/2009 Sanagi (Continued)

FOREIGN PATENT DOCUMENTS

CA 3005534 A1 * 11/2018 ..... F04D 27/001
JP 3704016 B2 10/2005
JP 6620427 B2 * 12/2019

OTHER PUBLICATIONS

JP-6620427-B2, English Language Machine Translation (Year: 2019).*

*Primary Examiner* — Wesley G Harris
(74) *Attorney, Agent, or Firm* — Thompson Coburn LLP

(57) ABSTRACT

A blower comprising a blower housing, a blower wheel, and a motor. The blower wheel is within the blower housing and has a plurality of blades. The motor is operatively connected to the blower wheel to rotate the blower wheel about an axis of rotation. The blower housing comprises a wall perpendicular to the axis of rotation. The wall has a static tap hole having a leading edge and a trailing edge. The static tap hole is positioned near an axial side of the blower wheel such that as the blower wheel rotates, any of the blades of the blower wheel passes the leading edge of the static tap hole before passing the trailing edge of the static tap hole. The wall comprises a protrusion protruding axially from the wall and toward the blower wheel. The protrusion is located adjacent the trailing edge of the static tap hole.

17 Claims, 10 Drawing Sheets

(56) References Cited

U.S. PATENT DOCUMENTS

| | | | | |
|---|---|---|---|---|
| 9,022,753 | B2 | 5/2015 | Streng et al. | |
| 2006/0051205 | A1 * | 3/2006 | Platz | F04D 29/4233 415/206 |

* cited by examiner

BLOWER HAVING A PROTRUSION ADJACENT THE STATIC TAP HOLE

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to a blower having a protrusion adjacent the static tap hole.

SUMMARY

One aspect of the disclosure is a blower comprising a blower housing, a blower wheel, and a motor. The blower wheel is within the blower housing and has a plurality of blades. The motor is operatively connected to the blower wheel to rotate the blower wheel about an axis of rotation. The blower housing comprises a wall. The wall is perpendicular to the axis of rotation of the blower wheel. The wall has a static tap hole having a leading edge and a trailing edge. The static tap hole is positioned near an axial side of the blower wheel such that as the blower wheel rotates, a point on the blower wheel passes the leading edge of the static tap hole before passing the trailing edge of the static tap hole. The wall comprises a protrusion protruding axially from the wall and toward the blower wheel. The protrusion is located adjacent the trailing edge of the static tap hole.

Further features and advantages, as well as the operation, are described in detail below with reference to the accompanying drawings.

Figure 1:
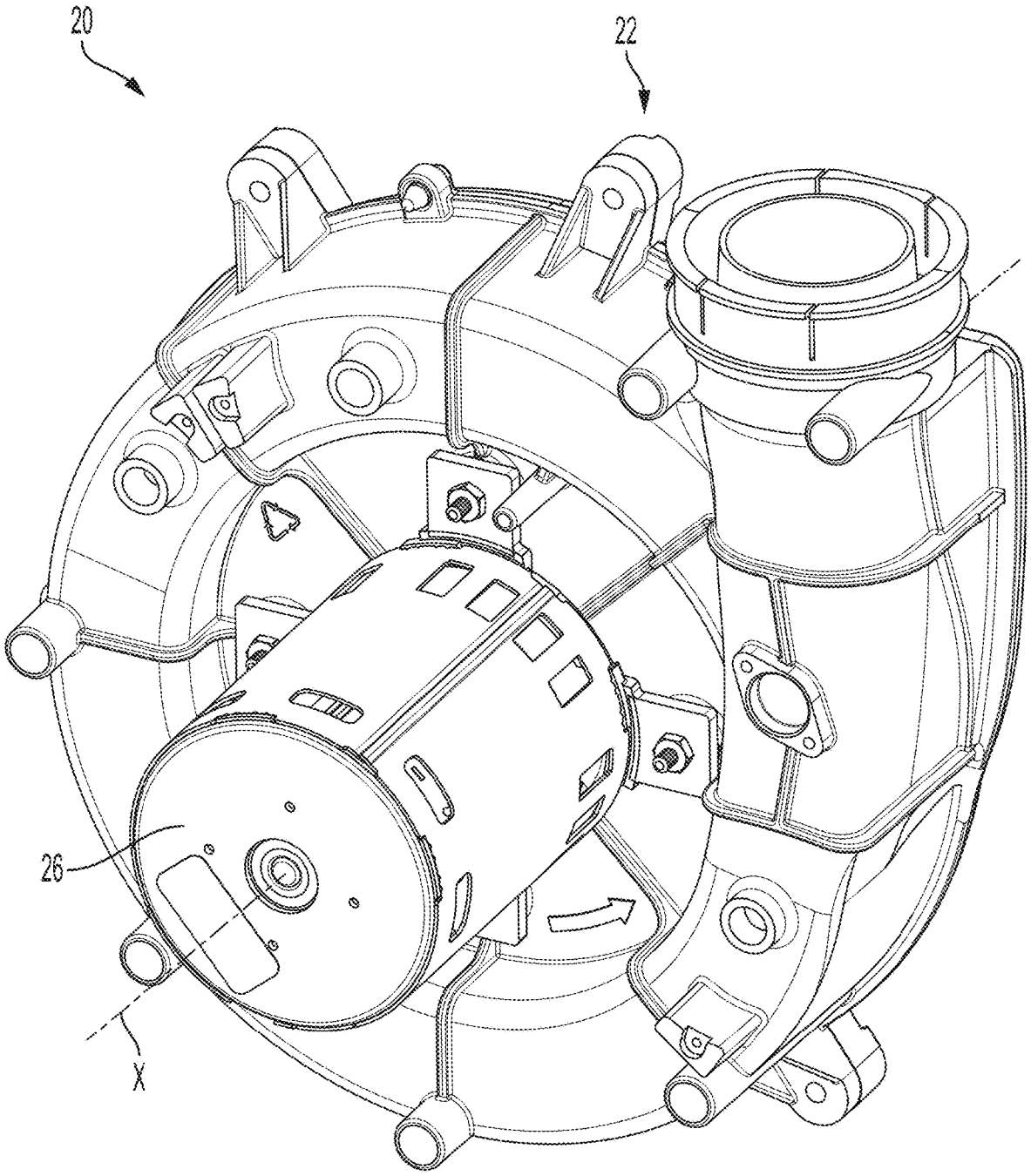
FIG. 1 is a perspective view of a blower.
Figure 2:
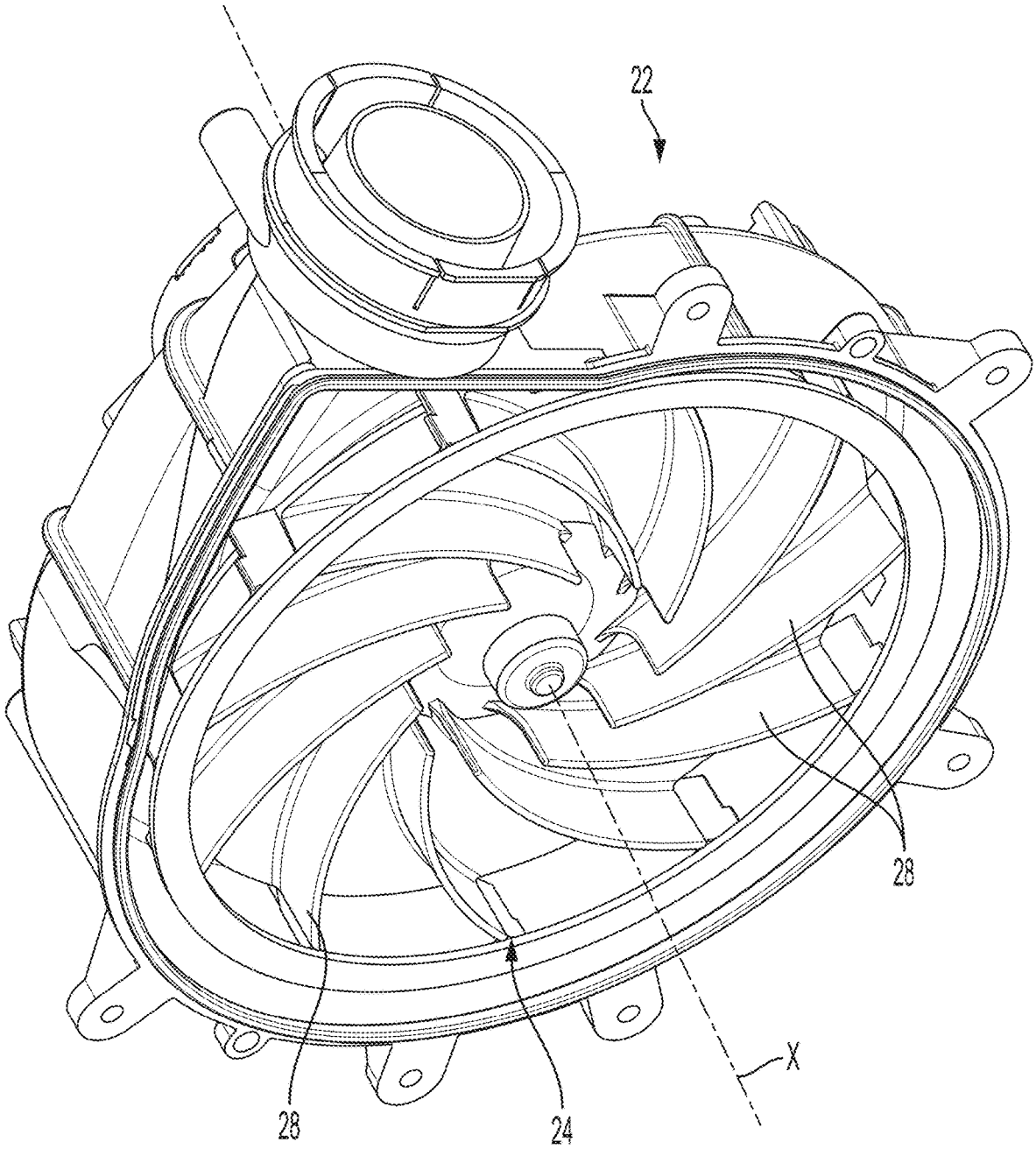
FIG. 2 is a perspective view of a blower housing with a blower wheel.

Reference numerals in the written specification and in the figures indicate corresponding items.

DETAILED DESCRIPTION

Figure 3:
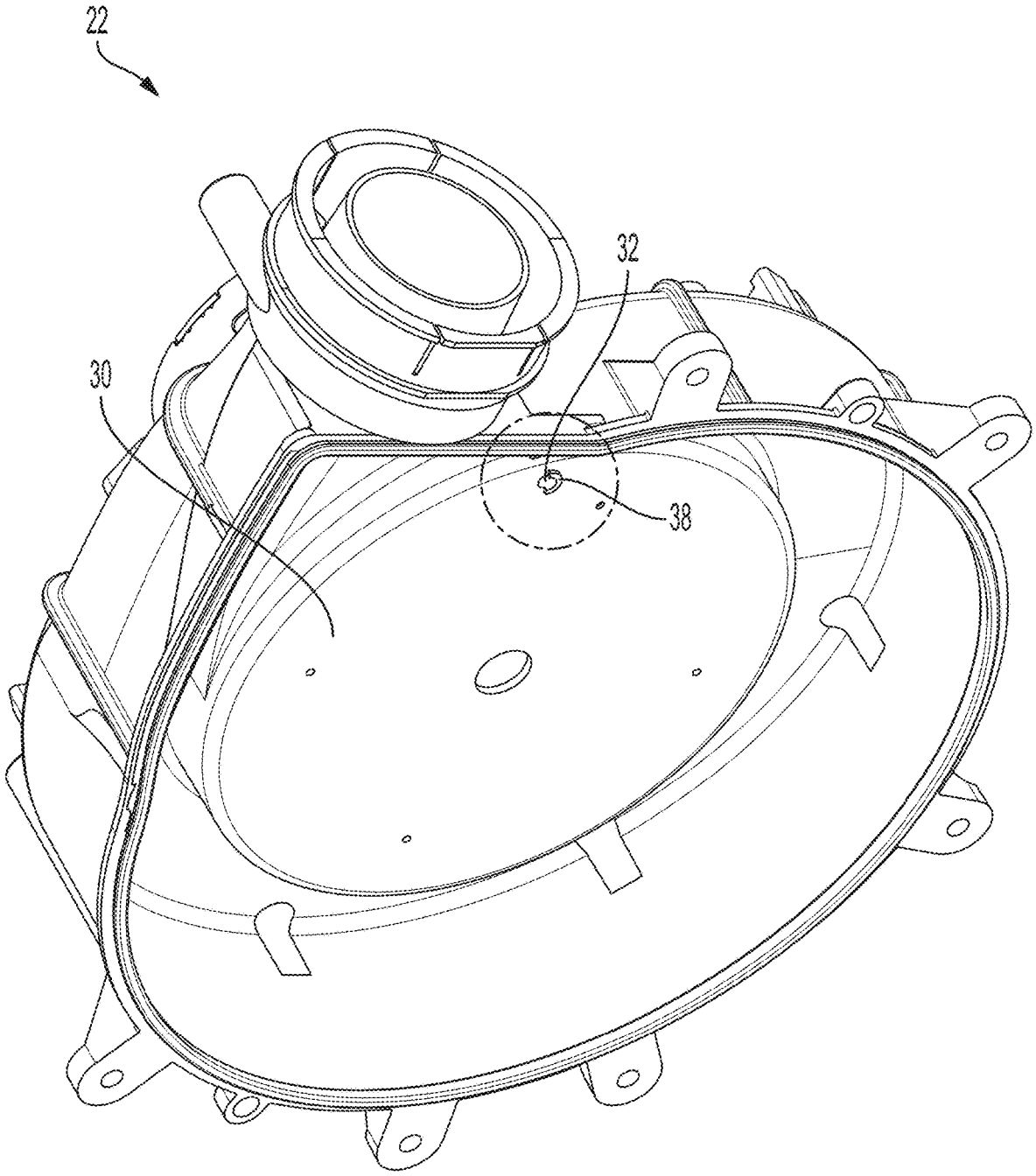
FIG. 3 is a perspective view of a blower housing.
Figure 4:
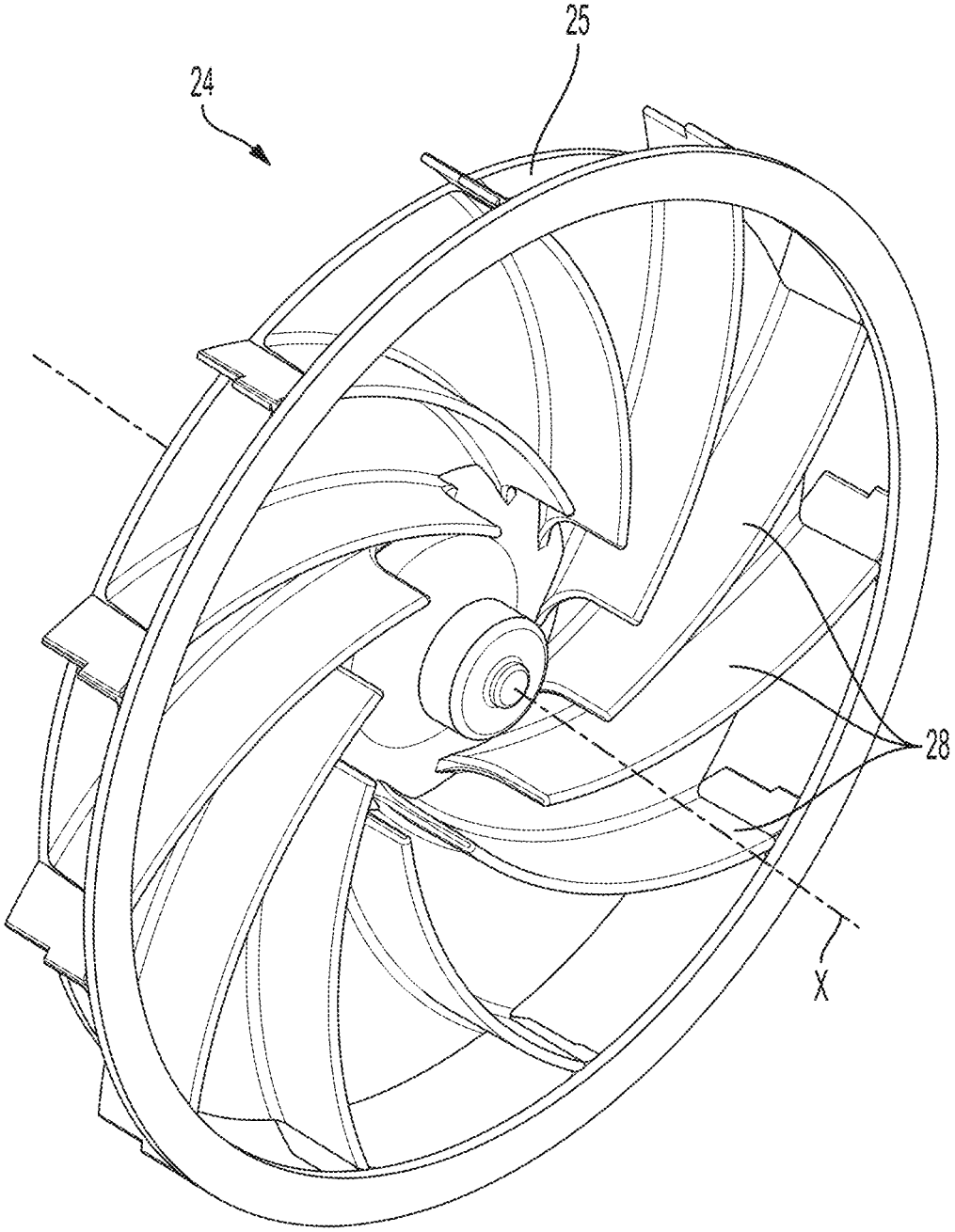
FIG. 4 is a perspective view of a blower wheel.

An embodiment of a blower in accordance with the present disclosure is indicated generally by reference number 20 (FIG. 1). The blower 20 comprises a blower housing 22, a blower wheel 24, and a motor 26. The motor 26 is operatively connected to the blower wheel 24 to rotate the blower wheel 24 about an axis of rotation X. The blower wheel 24 is within the blower housing 22. The blower wheel 24 may have a flat plate 25 from which a plurality of blades 28 protrude axially away from the motor. The blower housing 22 comprises a wall 30 (FIG. 3). The wall 30 is perpendicular to the axis of rotation X of the blower wheel 24 and spaced axially from the plate 25. The wall 30 has a static tap hole 32. The static tap hole 32 has a leading edge 34 and a trailing edge 36. The static tap hole 32 is positioned near an axial side of the blower wheel 24 such that, as the blower wheel 24 rotates, a point on the blower wheel 24 passes the leading edge 34 of the static tap hole 32 before passing the trailing edge 36 of the static tap hole 32. For example, the point on the blower wheel 24 may be a point on the flat plate 25. The wall 30 comprises a protrusion 38 protruding axially from the wall 30 and toward the blower wheel 24. The protrusion 38 is located adjacent the trailing edge 36 of the static tap hole 32.

The protrusion 38 may be located directly adjacent the trailing edge 36 of the static tap hole 32. Alternatively, the protrusion 38 may be within 0-6 millimeters from the trailing edge 36 of the static tap hole 32.

Figure 5:
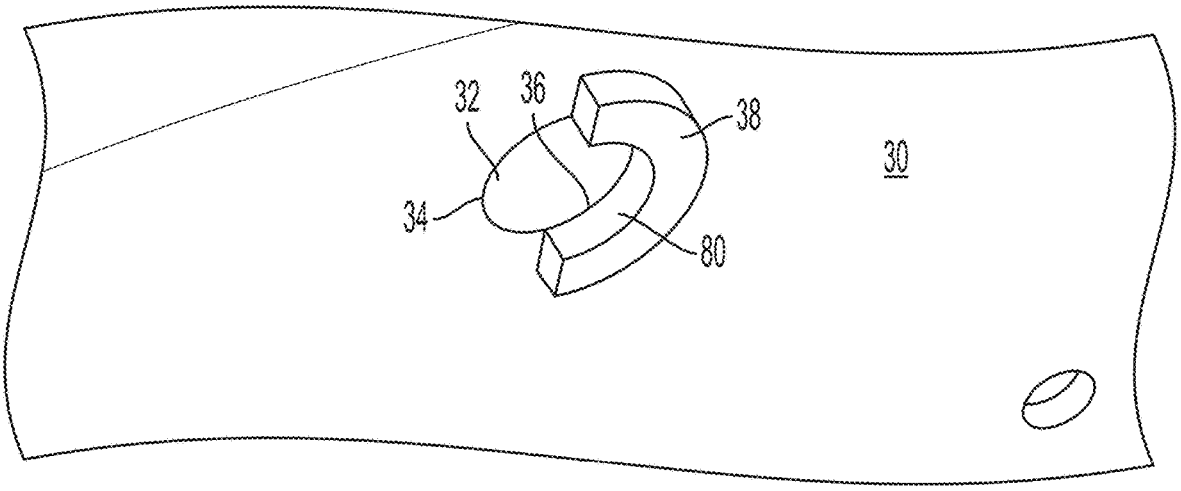
FIG. 5 is a magnified perspective view of a protrusion of a blower housing.
Figure 6:
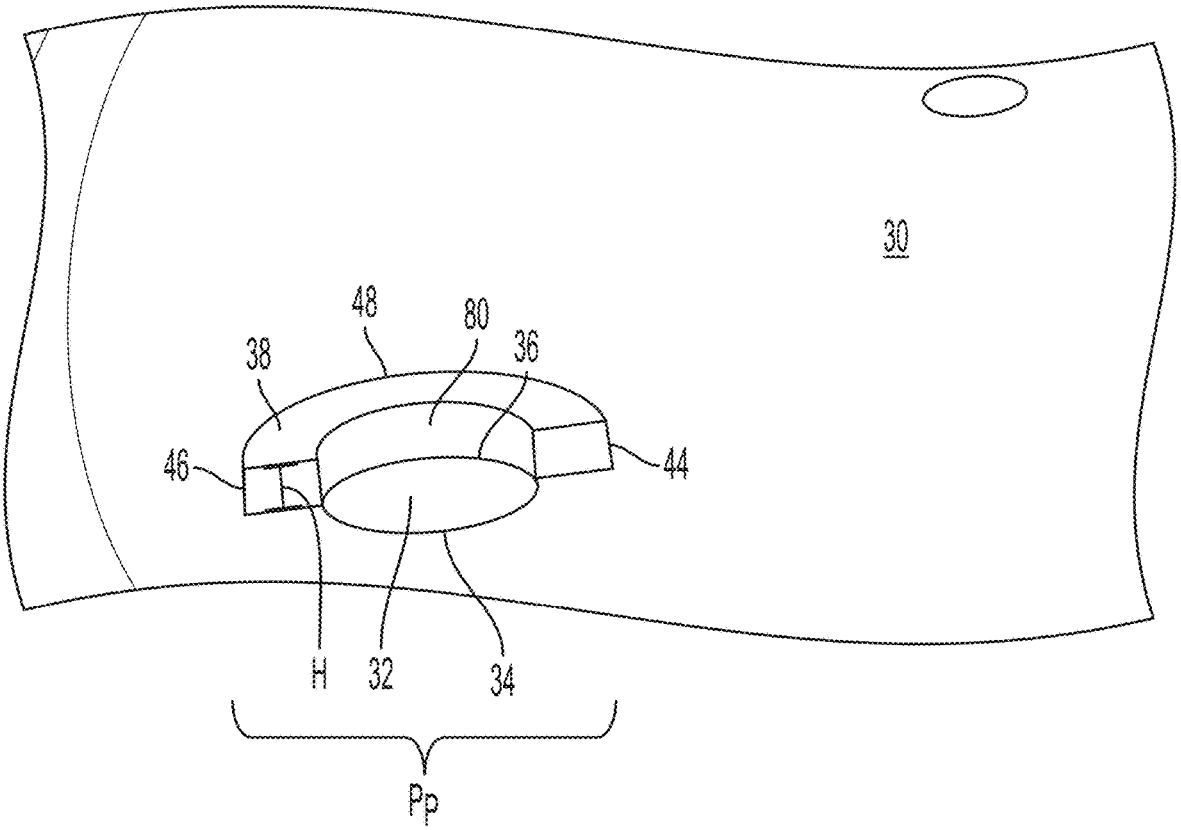
FIG. 6 is a magnified perspective view of the protrusion of FIG. 5.
Figure 7:
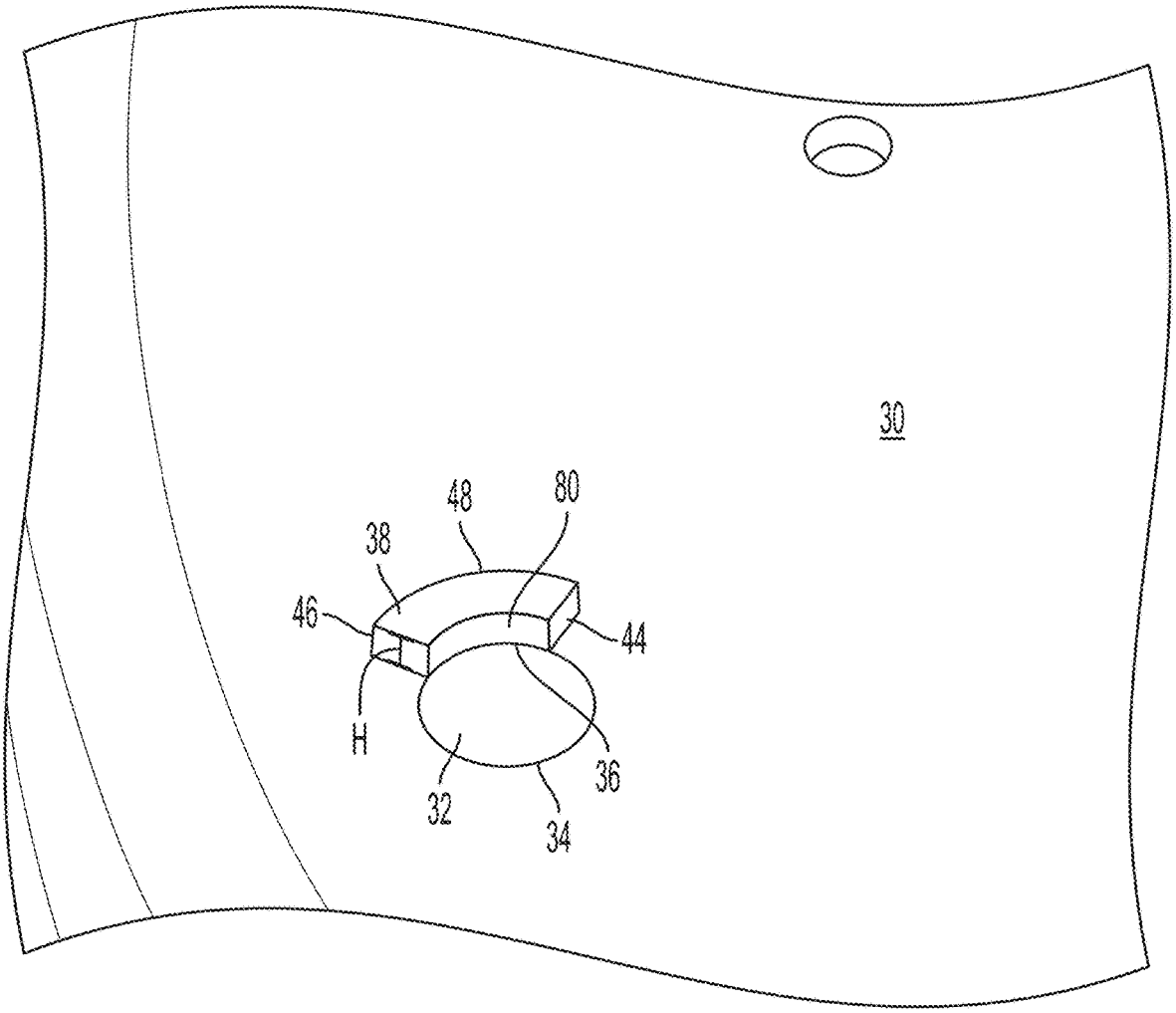
FIG. 7 is a magnified perspective view of the protrusion of a protrusion of a blower housing.

As shown in FIGS. 5-7, the protrusion 38 may have a variety of shapes. For instance, the protrusion 38 may have a planar surface facing the trailing edge 36 of the static tap hole 32. Alternatively, the protrusion 38 may have an arcuate surface 80 facing the trailing edge 36 of the static tap hole 32 and partially extending around the static tap hole 32. The arcuate surface 80 of the protrusion 38 may extend between about 20% and about 75% around the static tap hole 32. For example, the arcuate surface 80 of the protrusion 38 may extend between about 25% and about 75% around the static tap hole 32. As a second example, the arcuate surface 80 of the protrusion 38 may extend between about 50% and about 75% of the static tap hole 32. As a third example, the arcuate surface 80 of the protrusion 38 may extend between about 20% and about 40% of the static tap hole 32. As used here, the term "about" means ±2%. The arcuate surface 80 of the protrusion 38 may form a partial dome. Alternatively, the protrusion 38 may have a surface that is V-shaped in a cross section taken in a plane parallel to the wall 30.

The protrusion 38 has a height H that is uniform. The protrusion 38 may have a first side 44, a second side 46, and a middle 48 between the first side and the second side.

The protrusion 38 may be integrally molded with the wall 30, or the protrusion 38 may be insertable in the wall 30.

The positioning of protrusion 38 with respect to the static tap hole 32 causes air passing by the static tap hole 32 to be pushed back toward static tap hole 32 when the blower exhaust or an appliance flue is blocked. This results in negative pressure decreasing more rapidly, which allows the vacuum switch to trigger more quickly when a blockage occurs. Additionally, the positioning of protrusion 38 with respect to the static tap hole 32 permits the use of lower power motors with the blower 20, thereby reducing both the blower cost and power consumption.

Figure 8:
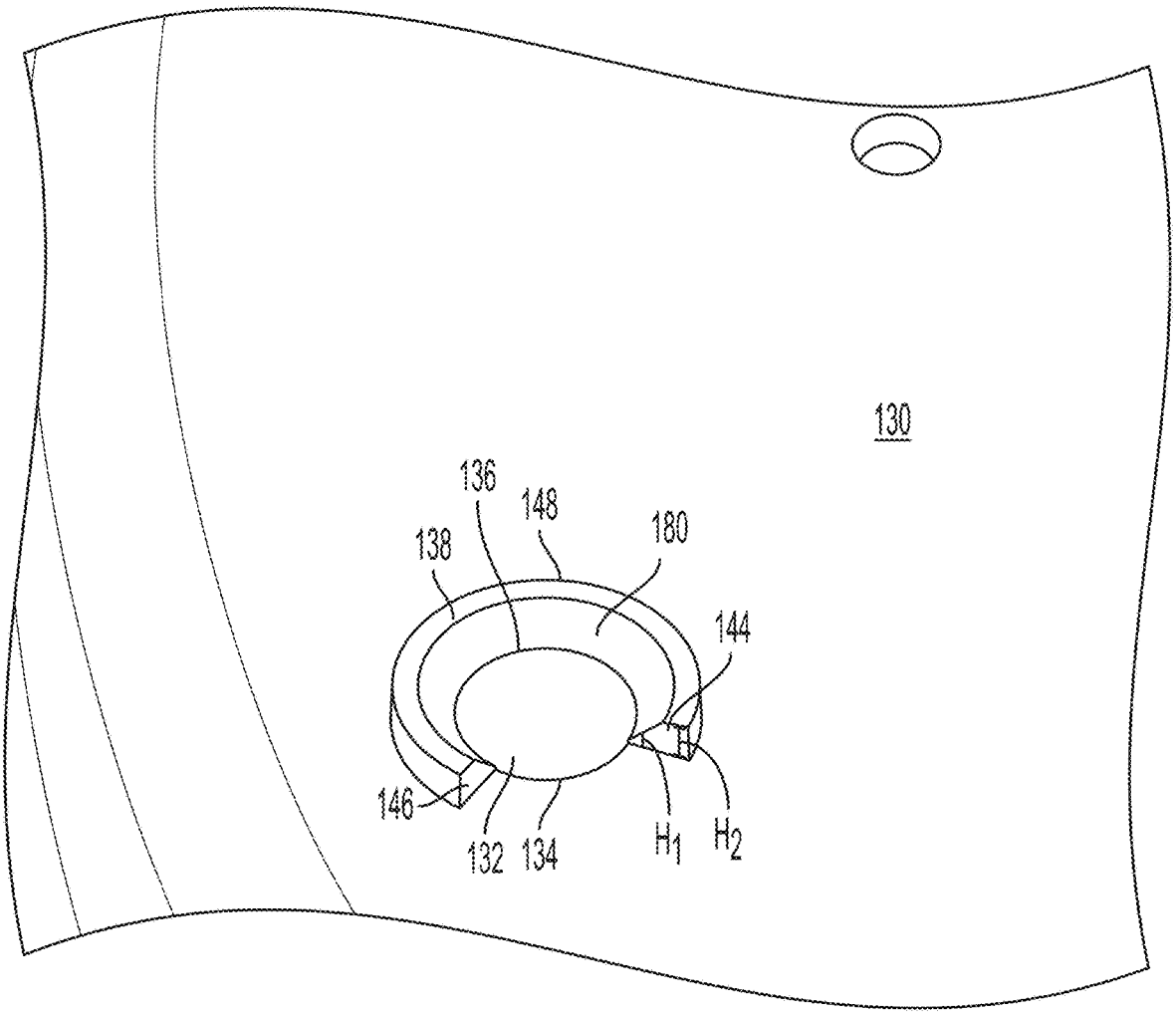
FIG. 8 is a magnified perspective view of another embodiment showing a protrusion of a blower housing.

Another embodiment of a protrusion, generally indicated at 138, is shown in FIG. 8. The above description of the blower 20 and protrusion 38 applies equally to the protrusion of FIG. 8, except for the differences noted in the description of the embodiment of FIG. 8 or as shown in the drawing of FIG. 8. It is also to be understood that components, elements, features, or regions of the embodiments of FIG. 8 have reference numbers corresponding to the reference numbers of the embodiment of FIGS. 1-7, except the reference numbers of the embodiment of FIG. 8 include a prefix "1."

The protrusion 138 shown in FIG. 8 has an arcuate surface 180 tapering toward the static tap hole 132. The protrusion 138 has a first height $H_1$ at one location on the protrusion 138 and a second height $H_2$ at another location on the protrusion 138 that is different from the first height. The protrusion 138 may be taller in the middle and shorter on the first and second sides 144, 146.

Figure 9:
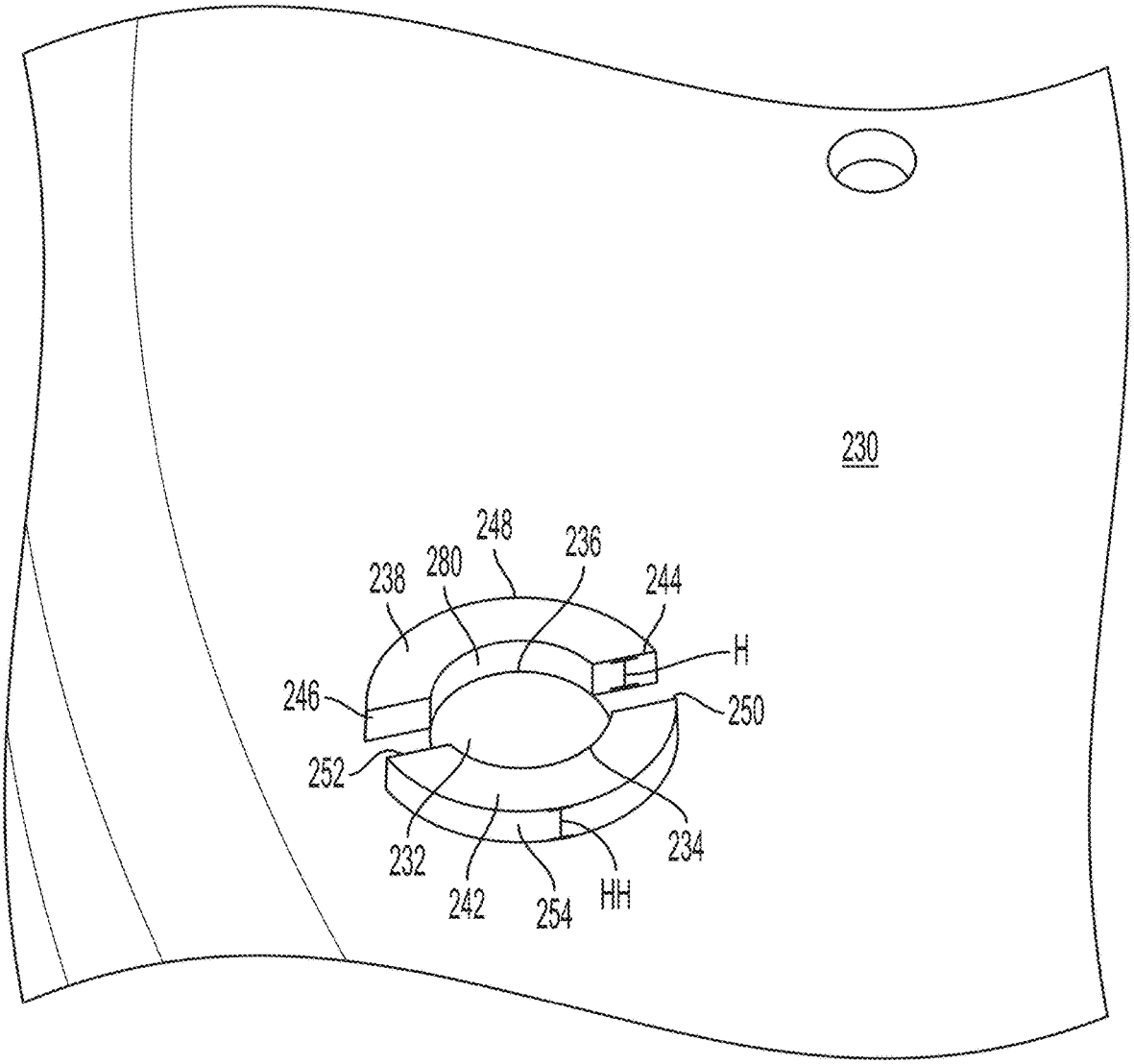
FIG. 9 is a magnified perspective view of a further embodiment showing a protrusion of a blower housing.

Yet another embodiment of a protrusion, generally indicated at 238, is shown in FIG. 9 The above description of the blower 20 and protrusion 38 applies equally to the protrusion of FIG. 9, except for the differences noted in the description of the embodiment of FIG. 9 or as shown in the drawing of FIG. 9. It is also to be understood that components, elements, features, or regions of the embodiments of FIG. 9 have reference numbers corresponding to the reference numbers of the embodiment of FIGS. 1-7, except the reference numbers of the embodiment of FIG. 9 include a prefix "2."

As shown in FIG. 9, the protrusion 238 may comprise a first protrusion 238, and the wall 230 may further comprise a second protrusion 242 protruding axially from the wall 230 and toward the blower wheel 224. The second protrusion 242 is located adjacent the leading edge 234 of the static tap hole 232.

The second protrusion 242 may have a variety of shapes. For instance, the second protrusion 242 may have a planar surface facing the leading edge 234 of the static tap hole 232. Alternatively, the second protrusion 242 may have an arcuate surface 280 facing the leading edge 234 of the static tap hole 232 and partially extending around the static tap hole 232. The arcuate surface 280 of the second protrusion 242 may extend around 25% of the static tap hole 232, or the arcuate surface 280 of the second protrusion 242 may extend around 50% of the static tap hole 232, or the arcuate surface 280 of the second protrusion 242 may extend around 75% of the static tap hole 232. The arcuate surface 280 of the second protrusion 242 may form a partial dome. Alternatively, the second protrusion 242 may have a surface that is V-shaped in a cross section taken in a plane parallel to the wall 230.

The second protrusion 242 may have a height HH that is uniform. The second protrusion 242 may have a first side 250, a second side 252, and a middle 254 between the first side and the second side 250, 252.

Both the first protrusion 240 and the second protrusion 242 may be integrally molded with the wall 230 or insertable in the wall 230.

Figure 10:
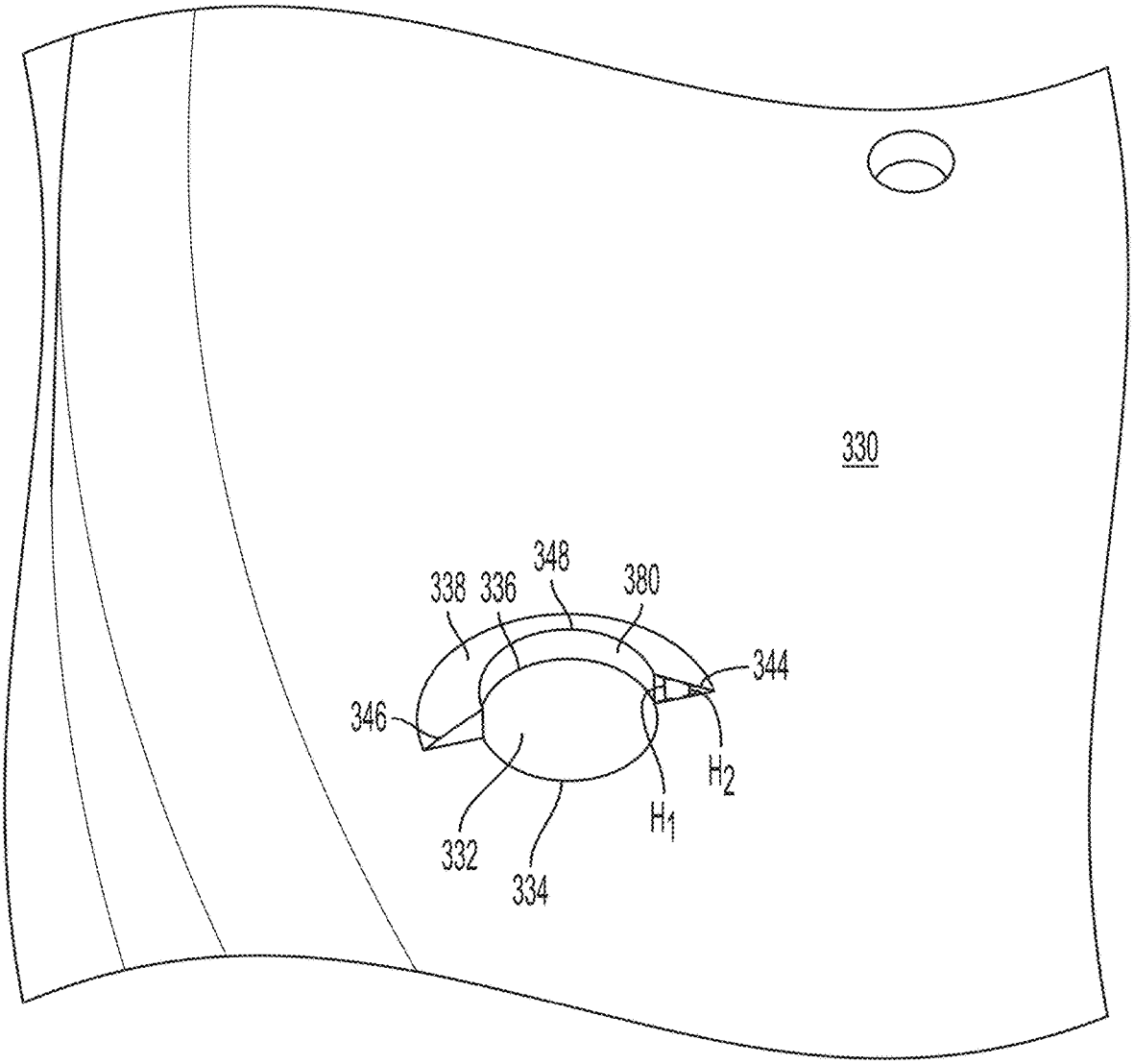
FIG. 10 is a magnified perspective view of yet another embodiment of a protrusion of a blower housing.

A further embodiment of a protrusion, generally indicated at 338, is shown in FIG. 10. The above description of the blower 20 and protrusion 38 applies equally to the protrusion of FIG. 10, except for the differences noted in the description of the embodiment of FIG. 10 or as shown in the drawing of FIG. 10. It is also to be understood that components, elements, features, or regions of the embodiments of FIG. 10 have reference numbers corresponding to the reference numbers of the embodiment of FIGS. 1-7 and the embodiment of FIG. 8, except the reference numbers of the embodiment of FIG. 10 include a prefix "3."

As with the embodiment of FIG. 8, the protrusion 338 has an arcuate surface 380. But the arcuate surface 380 tapers away from the static tap hole 332. The protrusion 338 has a first height $H_1$ at one location on the protrusion 338 and a second height $H_2$ at another location on the protrusion 338 that is different from the first height. The protrusion 338 may be taller in the middle and shorter on the first and second sides 144, 146. Alternatively, the protrusion 338 may be taller near the static tap hole 332 and shorter further from the static tap hole 332.

In view of the foregoing, it should be appreciated that the invention has several advantages over the prior art.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A blower comprising: a blower housing, a blower wheel, and a motor, the blower wheel being within the blower housing and having a plurality of blades, the motor being operatively connected to the blower wheel to rotate the blower wheel about an axis of rotation, the blower housing comprising a wall, the wall being perpendicular to the axis of rotation of the blower wheel, the wall having a static tap hole having a leading edge and a trailing edge, the static tap hole being positioned near an axial side of the blower wheel such that as the blower wheel rotates, a point on the blower wheel passes the leading edge of the static tap hole before passing the trailing edge of the static tap hole, the wall comprising a protrusion protruding axially from the wall and toward the blower wheel, the protrusion being located adjacent the trailing edge of the static tap hole, and wherein the protrusion extends no more than partially around the static tap hole.

2. The blower of claim 1 wherein the protrusion is directly adjacent the static tap hole.

3. The blower of claim 1 wherein the protrusion is within 0-6 millimeters from the trailing edge of the static tap hole.

4. The blower of claim 1 wherein the protrusion has an arcuate surface facing the trailing edge of the static tap hole.

5. The blower of claim 4 wherein the arcuate surface of the protrusion extends between about 25% and about 75% around the static tap hole.

6. The blower of claim 4 wherein the arcuate surface of the protrusion extends between about 50% and about 75% around the static tap hole.

7. The blower of claim 4 wherein the arcuate surface of the protrusion extends between about 20% and about 40% around the static tap hole.

8. The blower of claim 4 wherein the arcuate surface of the protrusion forms a partial dome.

9. The blower of claim 4 wherein the protrusion comprises a first protrusion, and wherein the wall comprises a second protrusion protruding axially from the wall and toward the blower wheel, the second protrusion being located adjacent the leading edge of the static tap hole.

10. The blower of claim 9 wherein the second protrusion has an arcuate surface facing the leading edge of the static tap hole and partially extending around the static tap hole.

11. The blower of claim 1 wherein the protrusion has a surface that is v-shaped in a cross section taken in a plane parallel to the wall.

12. The blower of claim 1 wherein the protrusion has a height, the height being uniform.

13. The blower of claim 1 wherein the protrusion has a height, the height being different at different locations of the protrusion.

14. The blower of claim 13 wherein the protrusion has a first side, a second side, and a middle, the middle being between the first side and the second side, the protrusion height being taller in the middle of the wall and shorter on the first and second sides of the wall.

15. The blower of claim 1 wherein the protrusion is insertable in the wall.

16. The blower of claim 1 wherein the protrusion is integrally molded with the wall.

17. The blower of claim 1 wherein the blower wheel comprises a flat plate, the flat plate being spaced axially from the wall, the plurality of blades protruding axially from the flat plate and away from the wall, the point on the blower wheel being on the flat plate.

* * * * *